US006128911A

United States Patent [19]

Mathews et al.

[11] Patent Number: 6,128,911

[45] Date of Patent: Oct. 10, 2000

[54] MODULAR REFRIGERATED STRUCTURES FOR DISPLAYING, STORING AND PREPARING REFRIGERATED PRODUCTS

[75] Inventors: Thomas J. Mathews, Wayne; James G. Boyko, Gorham; David G. Tovey, Falmouth; Larry A. Wichroski, Freeport, all of Me.; Jon Scott Martin, Conyers, Ga.; Sheldon F. Mashburn, Conyers, Ga.; Brian T. Kerry, Conyers, Ga.; Jesse H. Pickrum, Conyers, Ga.

[73] Assignee: Delaware Captial Formation, Inc., Wilmington, Del.

[21] Appl. No.: 09/059,988

[22] Filed: Apr. 14, 1998

Related U.S. Application Data

[60] Provisional application No. 60/070,942, Jan. 9, 1998.

[51] Int. Cl.[7] ..... A47F 3/04

[52] U.S. Cl. ..... 62/256; 62/298; 62/414

[58] Field of Search ..... 62/298, 246, 413, 62/414, 415, 416, 252, 253, 255, 256, 276, 80, 89

[56] References Cited

U.S. PATENT DOCUMENTS

| | | | |
|---|---|---|---|
| 2,774,225 | 12/1956 | Grilley et al. | 62/255 |
| 2,794,325 | 3/1957 | Shearer | 62/89.5 |
| 2,929,229 | 3/1960 | Detwiller | 62/426 |
| 2,984,085 | 5/1961 | Rainwater | 62/256 |
| 3,021,691 | 2/1962 | Jacobs | 62/256 |
| 3,119,241 | 1/1964 | Wile | 62/256 X |
| 3,123,988 | 3/1964 | Richman | 62/418 |
| 3,306,068 | 2/1967 | Allgeyer et al. | 62/256 |
| 3,365,907 | 1/1968 | Barroero | 62/256 |
| 3,392,543 | 7/1968 | Miller | 62/237 |
| 3,531,945 | 10/1970 | Brennan | 62/234 |
| 3,675,440 | 7/1972 | Ibrahim | 62/256 |
| 3,690,118 | 9/1972 | Rainwater | 62/250 |
| 4,242,882 | 1/1981 | Abraham | 62/256 |
| 4,267,706 | 5/1981 | Abraham | 62/256 |
| 4,369,632 | 1/1983 | Abraham | 62/82 |
| 4,373,355 | 2/1983 | Monroe | 62/256 |
| 4,633,677 | 1/1987 | Maehara | 62/256 |
| 4,777,806 | 10/1988 | Perez | 62/256 |
| 4,794,764 | 1/1989 | Dyment et al. | 62/250 |
| 5,086,627 | 2/1992 | Borgen | 62/229 |
| 5,097,673 | 3/1992 | Negishi | 62/256 |
| 5,477,702 | 12/1995 | Kennedy et al. | 62/256 |
| 5,704,221 | 1/1998 | Lego | 62/276 X |

*Primary Examiner*—Harry B. Tanner

*Attorney, Agent, or Firm*—Thomas, Kayden, Horstemeyer & Risley

[57] ABSTRACT

A modular refrigerated structure 10 includes a modular perimeter 12 which defines a refrigerated space 30, a plurality of display openings 24 about the perimeter 12 and at least one personnel access opening 32 for personnel ingress and egress to the refrigerated space 30. Shelves 40 are positioned at each display opening 24 for displaying products. A plurality of roof modules 56 are supported over the perimeter 12 and include a refrigeration module 67, an air passage 60 positioned above a centrally located storage area 38, an air distribution plenum 68 and air outlets 80 positioned adjacent the perimeter 12. The refrigeration module 67 includes refrigeration coils 74 and a fan 72, such that air is moved upwardly by fans 72 from the storage area 38 and into the refrigeration module 67, through the refrigeration coils 74, into the air distribution plenum 68 and laterally outwardly to the air outlets 80 about the perimeter 12 of the structure 10, and then downwardly between the display openings 24 and the shelves 40 for cooling products displayed on the shelves 40.

39 Claims, 12 Drawing Sheets

MODULAR REFRIGERATED STRUCTURES FOR DISPLAYING, STORING AND PREPARING REFRIGERATED PRODUCTS

This application claims the benefit of U.S. Provisional Application 60/070,942 filed Jan. 9, 1998.

FIELD OF THE INVENTION

The present invention relates generally to refrigerated structures for the display, storage and preparation of refrigerated products. More specifically, the present invention relates to a modular refrigerated structure adaptable to a variety of sizes, shapes, configurations and applications including displaying, storing and preparing refrigerated products while providing a refrigerated space free of refrigeration components.

DESCRIPTION OF THE PRIOR ART

Refrigerated cabinets for food product display, storage and preparation are well known in the retail grocery industry. These devices display and provide consumer access to refrigerated food products, or store food products, or provide a refrigerated space for preparation of food products, while they maintain the food products at adequately cold temperatures to prevent spoiling. The term "refrigerated" as used herein applies equally to devices for cooling products below room temperature, both at medium temperature (above 0° F.) and at low temperature (below 0° F.).

Prior art refrigerated cabinets are most often designed either for food display, food storage or food preparation. Food display cabinets typically include a metal frame construction surrounded by insulating material and a thin metal protective cladding. Food storage and food preparation cabinets typically include a foam panel construction finished with a metal, glass board or plywood cladding but without a structural frame. Some display and some combination storage and display cabinets are one sided reach-in cabinets that include insulated vertical glass doors that are mounted on hinges along the display side of the device which allow a consumer to open a door and reach into the cabinet and retrieve the products displayed on shelving mounted inside the cabinet. Some other display, combination display and storage, and combination display and preparation models are open, without doors, and rely on a curtain of air to maintain the temperature inside the cabinet.

A typical prior art display cabinet incorporates a refrigeration coil, fan assembly and associated elements, sometimes referred to as a refrigeration unit, at the base or in the back wall of the cabinet to provide a sufficient supply of cooling air to maintain the interior of the cabinet at a proper operating temperature. Routine defrosting of the refrigeration unit requires that the unit be shut off so that the flow of cooling air normally provided by that refrigeration unit to the cabinet is discontinued. Repair or maintenance of a prior art refrigerated display cabinet sometimes requires taking the entire cabinet out of service and, in most instances, requires unloading the products displayed in the cabinet so that a mechanic can have access to the malfunctioning components or so that the mechanic can work on the cabinet for a period longer than the time that would cause spoilage of the products in the cabinet. This usually involves a significant amount of labor and results in the inability to display and sell products from the cabinet until the refrigeration unit is returned to service. Additionally, since the refrigeration unit is often contained at the base of the cabinet, these cabinets can require a significant amount of labor in order to clean the cabinet interior because a portion or all of the displayed products must often be removed from the cabinet and the refrigeration unit partially disassembled so that debris and spilled liquids can be cleaned from the base of the cabinet. This process can consume valuable employee labor hours since each cabinet must be cleaned on a regular basis in order to comply with governmental and industry health standards.

A typical prior art food storage, food preparation or combination cabinet incorporates refrigeration units hung just below the roof of the cabinet and above the storage or preparation areas where service to the refrigeration unit can sometimes be performed by moving products within the cabinet and without requiring removal of the products from the cabinet during short maintenance periods. However, many of these structures can lack the ability to continue to store, display or prepare products during longer maintenance operations because the flow of cooling air to the cabinet could be discontinued when the refrigeration unit(s) is taken out of service or because the service activities require extensive disruption of either the cabinet contents, operations or both. Unless the products are moved to another refrigerated location, the products may warm, thaw and spoil. As with the prior art display cabinets, routine defrosting of the refrigeration unit also requires that the unit must be shut off so that the flow of cooling air normally provided by that refrigeration unit to the cabinet is discontinued. These cabinets can also pose a difficulty during cleaning because stored products often times must be removed from the cabinet prior to cleaning and additional care must be taken not to damage the refrigeration components located within the cabinet.

There is a need to place refrigeration unit(s) in arrangements where the refrigeration unit(s) are moved out of the refrigerated display, storage or preparation areas and away from the refrigerated products, so that products do not have to be moved or removed, or operations disrupted when a refrigeration unit requires maintenance. There is also a need to provide cooling air to refrigerated products and areas during periods when the refrigeration unit is being defrosted. Additionally, since store employees who restock a refrigerated display cabinet usually work in the consumer shopping aisle adjacent the exterior of the cabinet and tend to impede the flow of consumer traffic through shopping aisles and otherwise block consumer access to the displayed products, it is also desirable to use a combination display and storage refrigerated structure with a refrigerated space behind the product displays for storage of replacement products and for accommodating the employees who restock the displays of the combination display and storage refrigerated structure from inside the structure. The employees would no longer be required to place the products in the consumer shopping aisle and stand or squat in the aisle to restock the empty shelves but would have a restocking area behind the display area of the structure which is large enough to work in and to store new products in cold storage, thereby making it more convenient for employees to work in the refrigerated space.

Further, whenever employees will be working within the refrigerated space during stocking or preparation of products, there is a need to have the refrigeration unit direct the cooling air away from the employees and directly to the refrigerated products in order to increase worker comfort and improve the cooling efficiency and the thermal efficiency of the structure by directing refrigerated air where it is needed.

Additionally, prior art commercial food refrigeration cabinets are typically shipped to a supermarket where they are to be installed and then the cabinets are arranged in positions within the store where the shape of the store and accessibility to utility hook-ups permit installation of the cabinets. Skilled on-site trade laborers, such as electricians and plumbers, then prepare the cabinets for use by making electrical and drain connections for each cabinet. This labor intensive procedure, which is necessitated by each cabinet requiring its own individual utility hook-ups, can significantly increase the cost of installing the prior art cabinetry. Therefore, it would be desirable to provide an improved free standing refrigerated structure, prefabricated at a manufacturing site and later delivered to and erected at the supermarket, which incorporates a single points of connection for power, drainage or any other required utility hook-ups. The structure would include a plurality of perimeter modules, roof modules and refrigeration modules which can be linked together to form a refrigerated display structure, a refrigerated storage structure, a refrigerated preparation structure or a combination of such structures of various sizes and configurations to satisfy the needs of the market where the structure is to be installed.

It would also be desirable to provide a modular refrigerated structure which has rugged, versatile perimeter modules, roof modules and refrigeration modules which, when assembled, support one another with a minimum of additional structural elements.

With the forgoing desires and disadvantages of the prior art in mind, it is an object of the present invention to provide an improved modular refrigerated structure which includes an interior refrigerated space and which is adaptable to a variety of sizes, configurations and applications according to customer need and which directs a flow of cold refrigerated air to desired locations within or at the perimeter of the structure to meet the specific refrigeration needs of each size, configuration and application.

It is another object of the invention to provide an improved modular refrigerated structure for refrigerated products which includes a plurality of air handling roof modules that form the roof of the structure, and a support structure which supports the roof.

It is another object of the invention to provide an improved modular refrigerated structure of modular construction for refrigerated products that includes a plurality of display modules and support modules that form a perimeter of the structure, and a plurality of air handling roof modules which mount on the display modules and at least one refrigeration module which includes a refrigeration unit for cooling the air within the structure and generating a flow of refrigerated air for cooling the refrigerated products in the modular structure.

It is still another object of the invention to provide an improved refrigerated structure that, in some embodiments, includes a continuous perimeter formed by side-by-side display modules with an array of display openings formed by the display modules, storage and display shelves adjacent the display openings, a modular roof structure, and refrigeration modules that include refrigeration units for cooling the air in the structure and creating a refrigerated interior space sufficient for cold storage of replacement refrigerated products, for restocking products, and in some embodiments for preparing products from inside the structure, all of which embodiments allow for maintenance personnel to work on top of the modular roof structure when servicing the refrigeration modules.

It is yet another object of the present invention to provide a modular refrigerated structure that includes refrigeration modules arranged so that when one refrigeration module is being serviced or its defrosted the other refrigeration modules continue to cool the air in the structure and provide a flow of cooling air to all of the refrigerated space.

Another object of the invention is to provide a refrigerated structure with a modular construction such that any combination of refrigerated display, storage and preparation structures can be formed by linking together compatible and, in some embodiments, identical display modules, identical support modules, identical roof modules and identical refrigeration modules.

Another object of the invention is to provide a modular refrigerated structure formed from an assembly of display modules and air handling roof modules mounted on the display modules, with the roof modules supporting the refrigeration modules of the structure, and with the roof modules and the refrigeration modules arranged to collectively direct cool air to all of the refrigerated structure even during periods when one of the refrigeration modules is being serviced or defrosted.

Other objects, features and advantages of the present invention will become apparent upon reading the following specification, when taken in conjunction with the accompanying drawings.

SUMMARY OF THE INVENTION

Briefly described, the present invention comprises a modular structure for containing products within a refrigerated space that positions the refrigeration coils and associated refrigeration components outside the refrigerated space within a refrigeration module, while providing access to the refrigeration components from atop and outside the modular refrigerated structure. Additionally, the present invention provides cooling air flow redundancy to the refrigerated space by allowing cooling air from one refrigeration module to provide cooling air to portions of the modular structure which normally receive cooling air from a separate refrigeration module so that refrigeration modules can be taken out of service for maintenance or defrosting without significantly degrading the flow of cooling air to the refrigerated space. Unlike typical prior art refrigerated cabinets which only display products, store products or provide an area for preparation of products, the modular construction of the present invention enables the manufacturer to build modular components for use in modular refrigerated structures at a central manufacturing site and erect variable size, configuration and application modular refrigerated structures at an installation site including, among others: continuous perimeter structures with display openings about the entire perimeter which allows a customer to freely walk around the structures and view displayed products from all sides; preparation rooms like those typically found in retail grocery stores (e.g. butcher/meat processing rooms) which can incorporate display openings for displaying products; storage structures (e.g. walk-in freezers) that do not incorporate display openings; and combination display and storage structures (e.g. store perimeter-conforming dairy cases) that provide display openings for products on at least one side while providing refrigerated space for storing products behind the display openings. Additional embodiments include structures having display openings facing in one general direction and which can back up against a wall of a building, against another one sided modular structure or against prior art cabinets.

In several of the embodiments, the modular refrigerated structure incorporates a free standing design with display modules which include display openings and which are assembled side-by-side to form a modular perimeter; display shelving adjacent the display openings of the display modules; and, a modular roof structure that is supported on top of the modular perimeter and on top of support uprights which support the display shelving. Each display module is adapted to join to additional display modules in a liking arrangement so that the perimeter is adaptable to a variety of sizes and configurations such as a continuous perimeter design, a linear aisle design, a sawtooth aisle design and a store perimeter-conforming design, among others. Typically, the perimeter of each of the structures defines a refrigerated space and can include at least one personnel access opening which is adapted to accommodate ingress and egress of personnel and products into the refrigerated space when the refrigerated structure has been configured to accommodate stored refrigerated products. The perimeter-forming display modules can incorporate display doors which mount to the exterior of the display modules in order to close the display openings.

The refrigerated space can incorporate a refrigerated products storage area as well as shelves, hooks, baskets or other display devices mounted adjacent the display openings for displaying products. The display devices can be incorporated into the individual display modules by fastening to a series of display support uprights which are part of the display modules and which are located adjacent the storage area. The storage area can provide space for storing boxes of replacement products within the structure or on the display shelving so that when the shelves require restocking with products, an employee enters the storage area, locates a quantity of previously stored products and restocks the shelves with the previously stored products. In other embodiments, portable display devices such as rolling display carts incorporating display shelves or other display means can be placed adjacent the display openings within the refrigerated space so that an entire display opening can be restocked by removing a cart depleted of its products and replacing it with a new cart containing a full supply of displayed products. Because several embodiments of the refrigerated structure are adaptable to these restocking methods, the exterior shopping aisles adjacent the structure can remain free of refrigerated products and employees during restocking, thereby relieving congestion of potential consumer traffic flow in the shopping aisles.

The modular refrigerated structure of the present invention also incorporates air handling roof modules which function as structural roof panels. In the embodiment having a continuous perimeter with display openings facing in all directions and incorporating the interior storage area, the air handling roof modules form the roof structure and are supported by the exterior facia of the display modules and the display support uprights. Each air handling roof module includes an air passage positioned above the storage area, an air distribution plenum and a plurality of air outlets directed toward the perimeter of the structure above the display openings. At least one refrigeration module mounts on top of the roof structure and includes at least one fan which is mounted at the air passage, a refrigeration plenum and at least one refrigeration coil which is located in the refrigeration plenum between the fan and the refrigerated air outlets. The fans operate in fluid communication with the refrigeration module such that the fans draw air upwardly from the interior storage area, through the air passage and into the refrigeration module. The fans and the shape of the refrigeration module then force the air through each of the refrigeration coils, into the refrigeration plenum, then into the air distribution plenum toward the air outlets at the perimeter of the refrigerated structure, then through the air outlets which direct the air downwardly between the display openings and the display shelves of the display modules so that the products displayed on the shelves are cooled by a flow of cold refrigerated air.

In this configuration, personnel within the modular refrigerated structure are not directly exposed to the high velocity cold refrigerated air flows directed at the displayed products. This directed refrigerated air flow provides a more comfortable environment for personnel within the refrigerated structure and an efficient means for refrigerating the displayed products. Additionally, some embodiments of the refrigerated structure also can include auxiliary fans mounted below the display openings to urge the flow of refrigerated air downwardly past the display openings and about the displayed products and thereafter direct the air toward the storage area for recirculation into the air handling roof module.

Each air handling roof module is adapted to be placed adjacent other air handling roof modules such that several roof modules can be arranged and connected in side-by-side alignment with each other. When so aligned, the respective air distribution plenum of each roof module can engage in fluid communication with the other air distribution plenums attached thereto. In this configuration, cold air produced from one refrigeration module can provide its cold air to air outlets positioned in the air distribution plenum of an adjacent roof module. Because of this refrigeration design redundancy, a refrigeration module can be taken out of service for maintenance or defrosting without significantly reducing the flow of cold refrigerated air to the products displayed throughout the entire refrigerated structure. This represents an improvement over the prior art which shuts off the flow of cold air to a section of a large cabinet during defrosting or during maintenance, possibly requiring additional labor to move the displayed products from the cabinet to a different refrigerated location.

Additionally, refrigeration modules which mount on the roof of the refrigerated structure each can incorporate a maintenance access door. The access door provides a convenient means for mechanics to obtain access to the interior of the refrigeration module and to most of the components contained therein. Because of access to the refrigeration coil, fan and associated refrigeration components on top of the structure, a mechanic can work on the top of the structure during maintenance and be out of the way of the customers in the customer shopping aisles.

Furthermore, since the refrigeration modules are on the top of the structure and outside the refrigerated space, cleaning of the refrigerated space typically can be accomplished without the time and cost of labor associated with disassembling portions of the refrigeration unit and the requisite removal of the products contained within the structure which could otherwise be required.

Other objects, features and advantages of the present invention will become apparent upon reading the following specification, when taken in conjunction with the accompanying drawings.

BRIEF DESCRIPTION OF THE DRAWINGS

The accompanying drawings incorporated in and forming a part of the specification illustrate several aspects of the present invention, and together with the description serve to explain the principles of the invention. The components in the drawings are not necessarily to scale, emphasis instead being placed upon clearly illustrating principles of the present invention. In the drawings appended hereto, like numerals illustrate like parts throughout the several views.

DETAILED DESCRIPTION OF THE PREFERRED EMBODIMENTS

Figure 1:
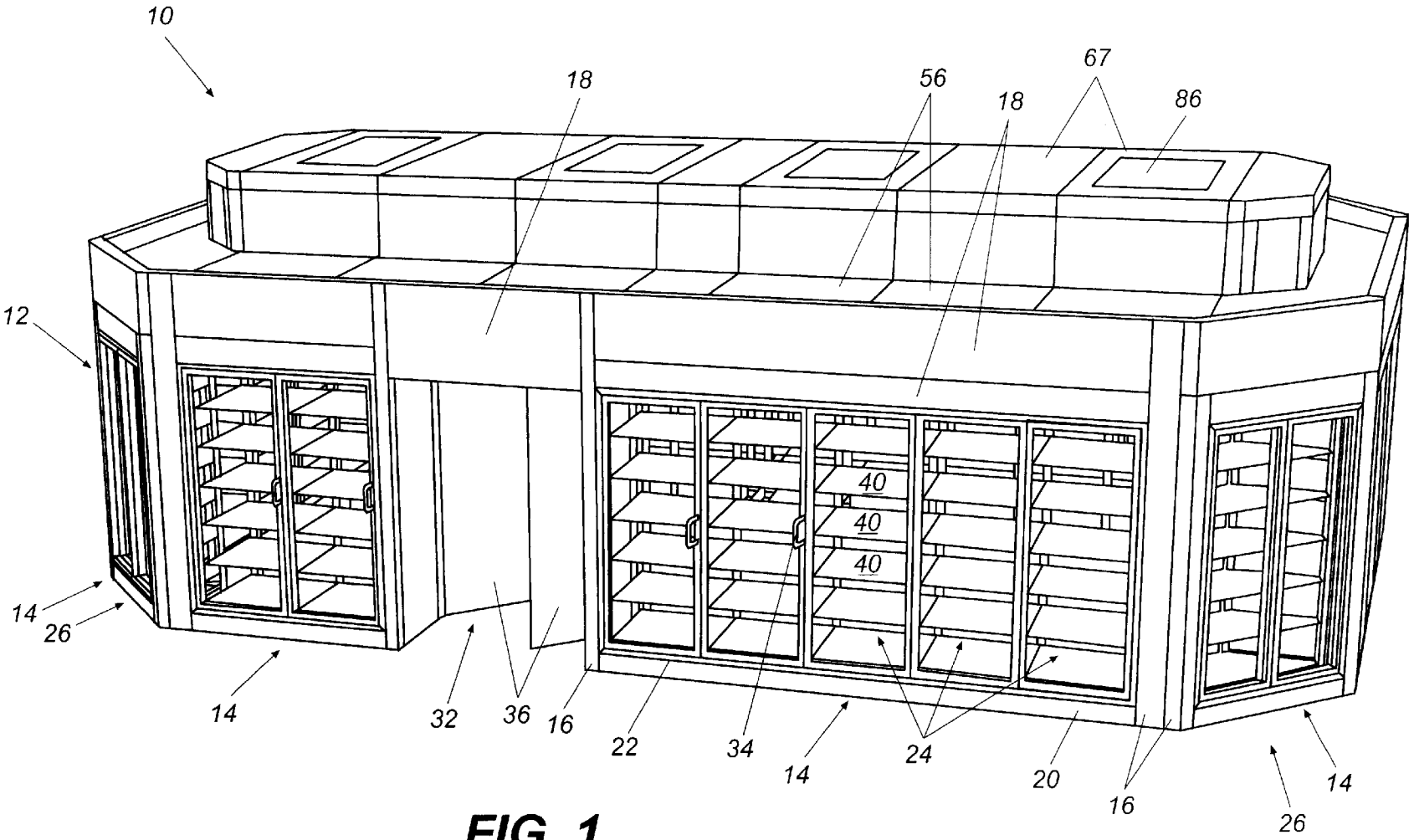
FIG. 1 illustrates a perspective view of the preferred embodiment of the present invention.
Figure 2:
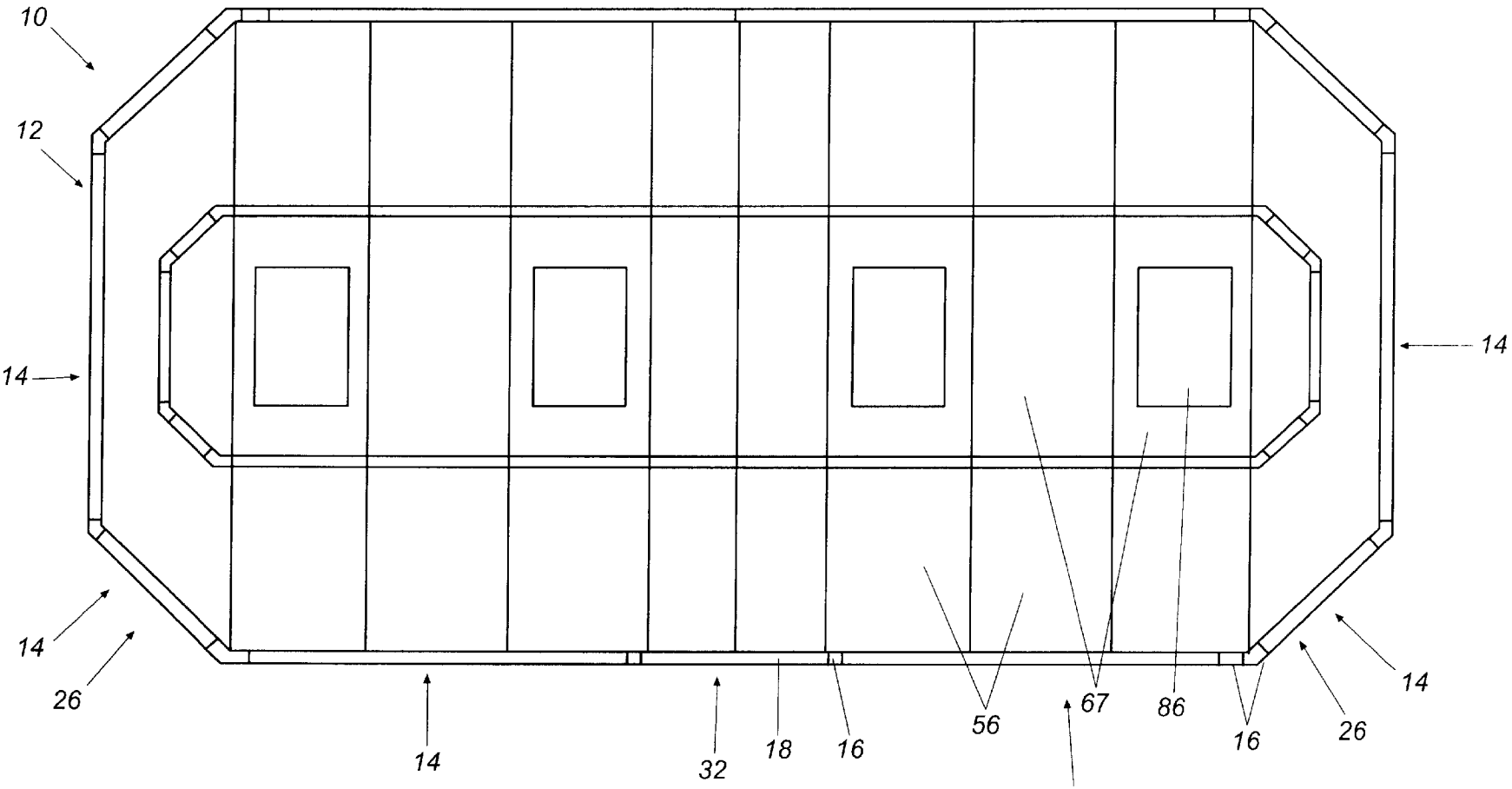
FIG. 2 illustrates a top view of the present invention.
Figure 3:
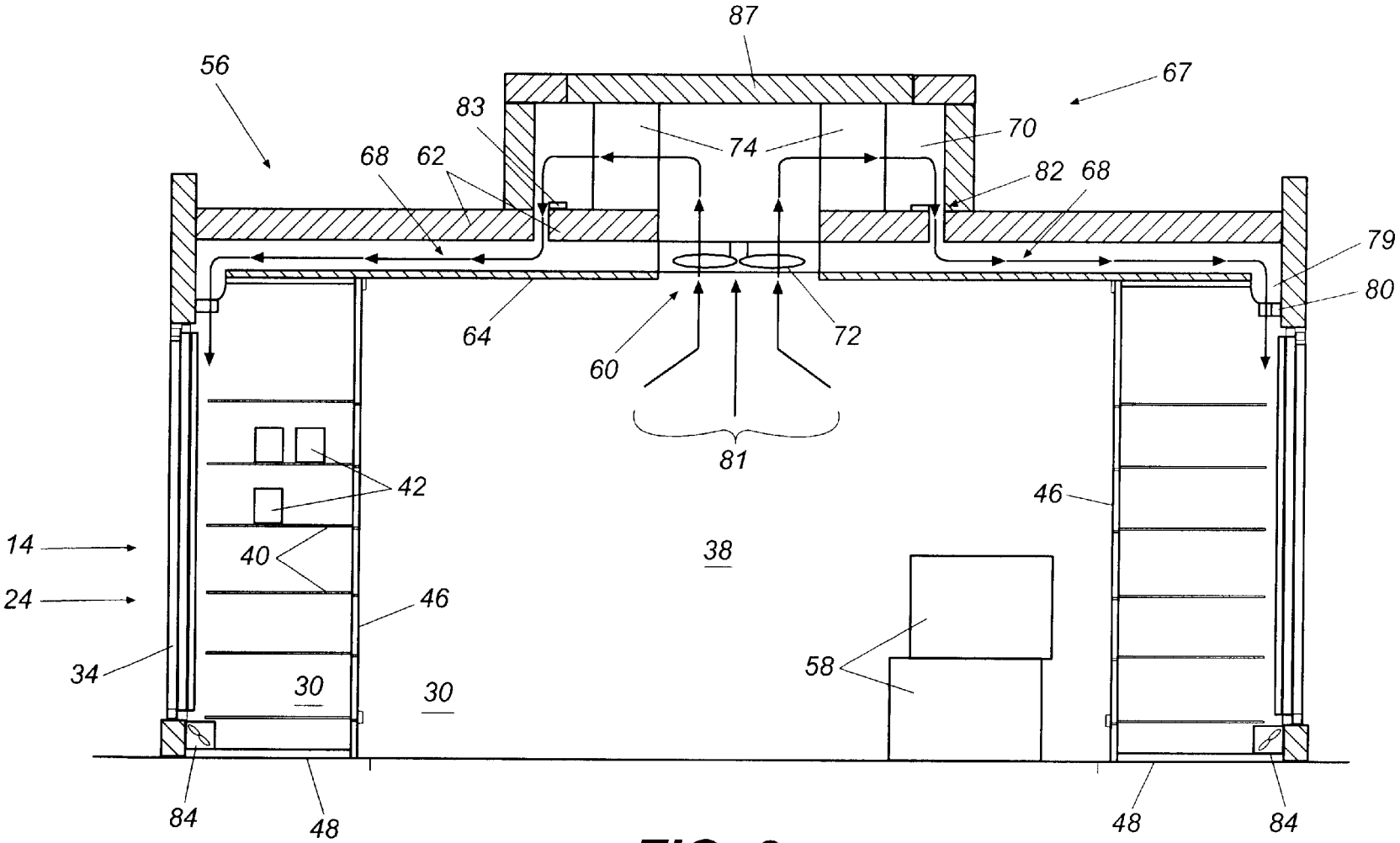
FIG. 3 illustrates a cross-sectional end view of the present invention showing the plenum chamber, display shelves and the storage area.
Figure 4:
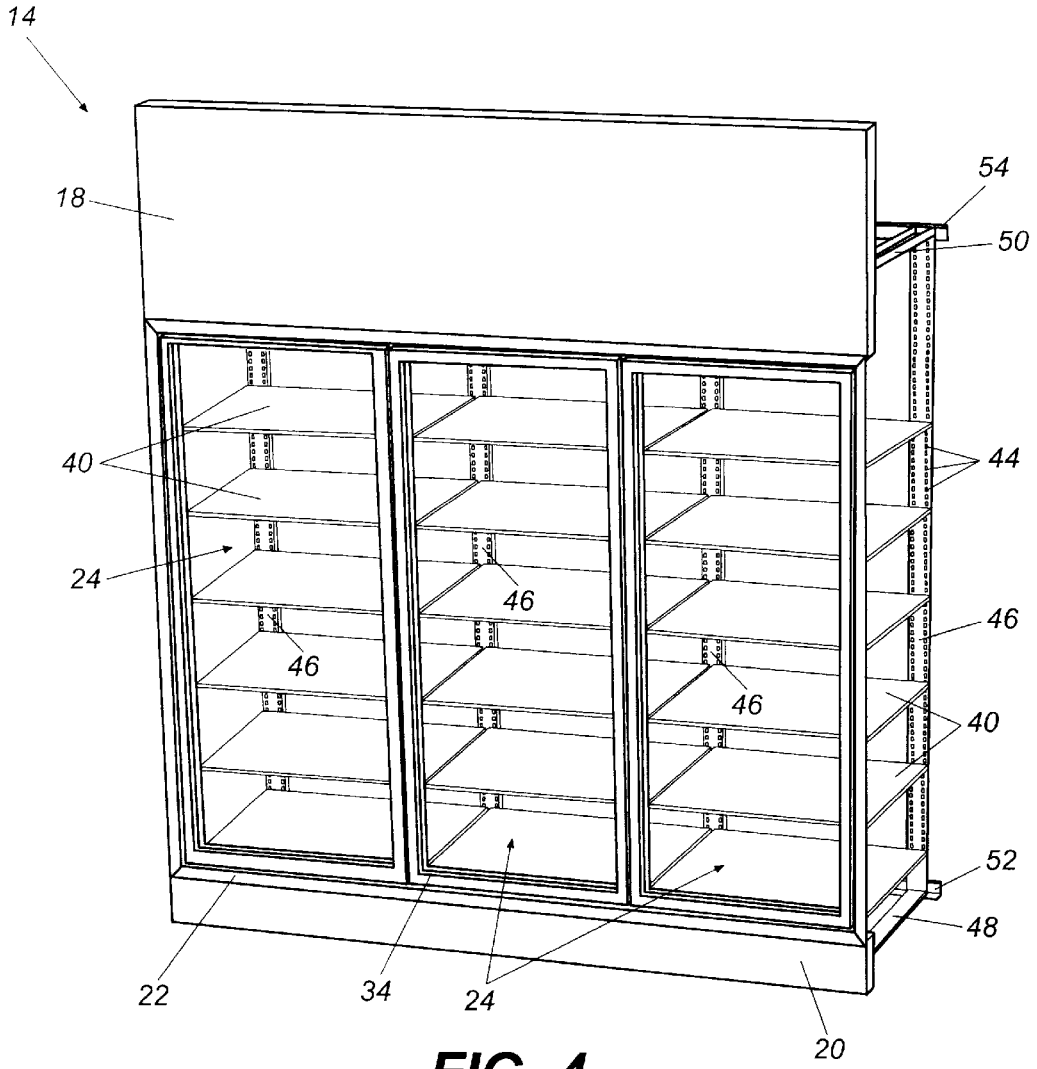
FIG. 4 illustrates a perspective view of a display module.

Reference will now be made in detail to the description of the invention as illustrated in the drawings. FIGS. 1, 2 and 3 illustrate the preferred embodiment of the modular refrigerated structure 10 which is adapted to display and store refrigerated products. The refrigerated structure 10 is a free standing design constructed with a perimeter 12 that acts as a support frame for the structure 10. The perimeter 12 is formed by a plurality of interlocking display modules 14, one of which is illustrated in FIG. 4, with insulated filler panels 16 between the modules 14 as may be necessary. Each display module 14 has upper and lower insulated facia panels, 18 and 20 respectively, which in combination with insulated filler panels 16 encase an exterior display frame 22 which includes from one to five display openings 24 disposed within display frame 22.

Figure 5:
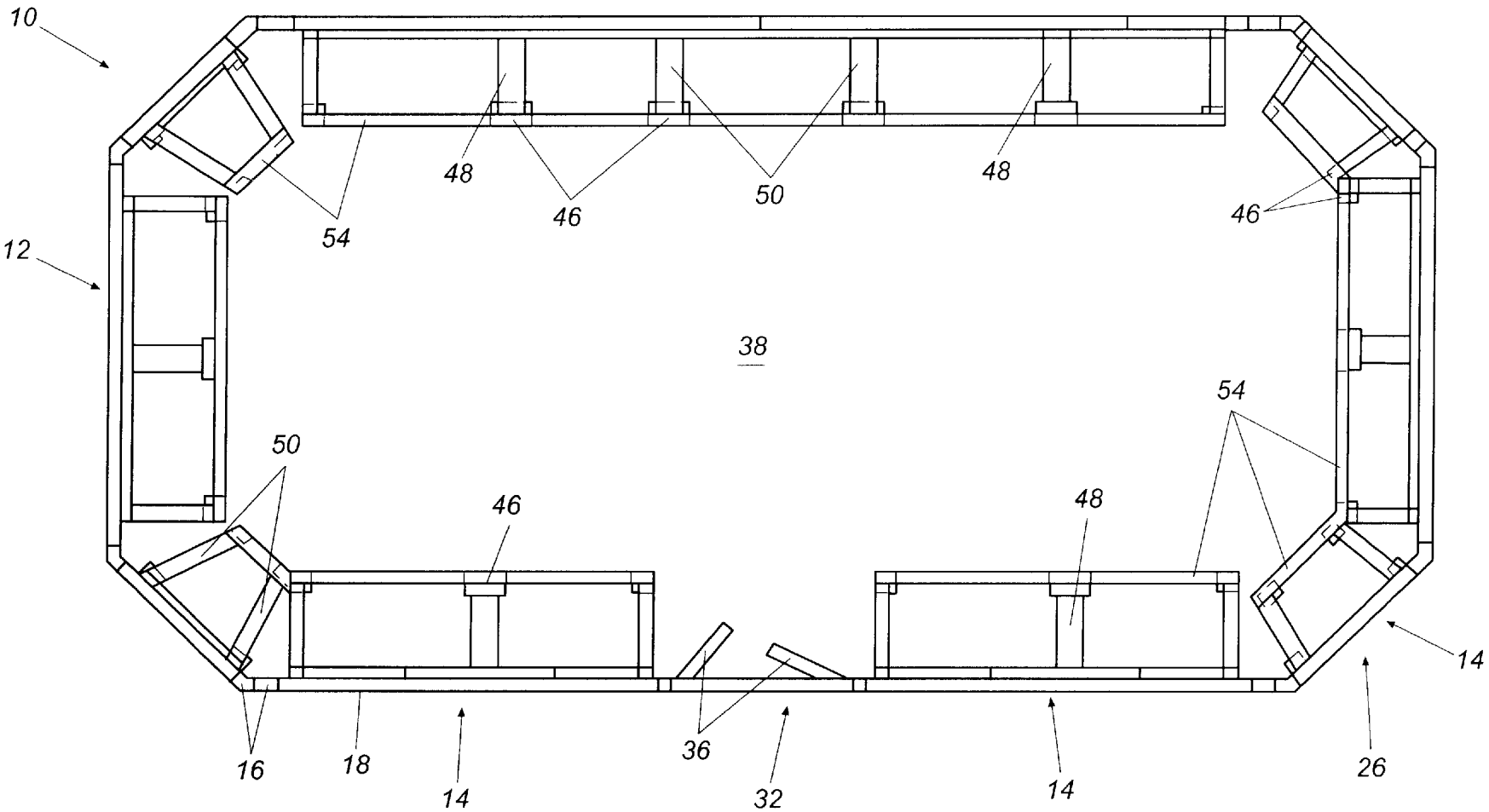
FIG. 5 illustrates a plan view of the invention.
Figure 6:
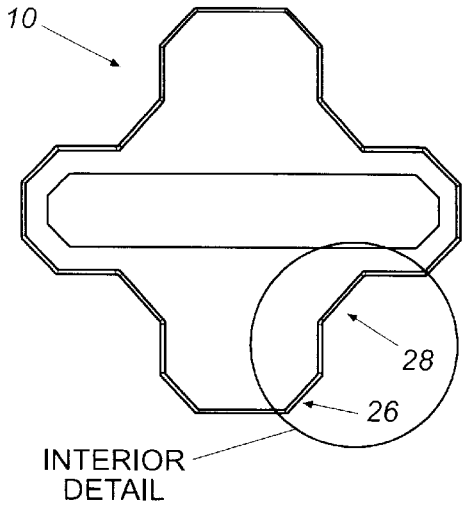
FIG. 6 illustrates a plan view of an alternative embodiment of the invention.
Figure 7:
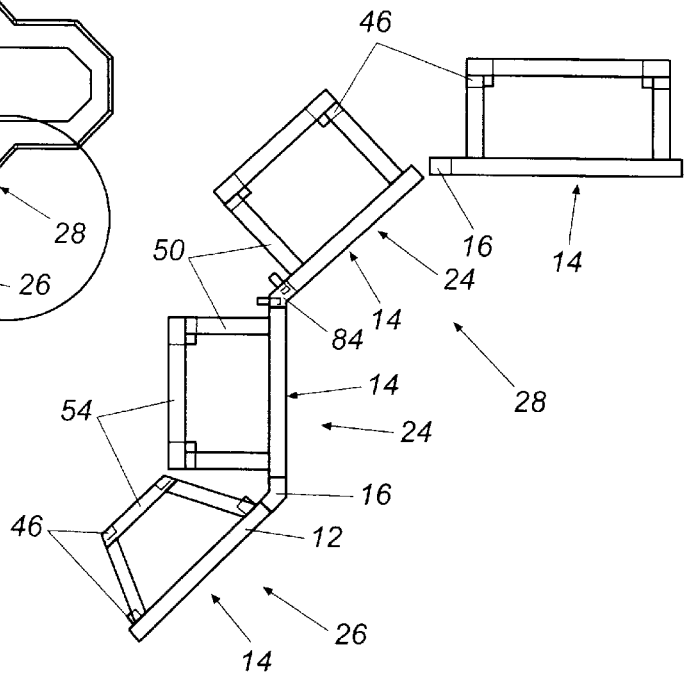
FIG. 7 illustrates a plan view showing detail of the interior bracing and display support uprights.

Each display module 14, as shown in FIG. 4, is adapted to be positioned in side-by-side relationship with similar display modules 14, i.e. upper and lower facia panels 18 and 20 of adjacent modules 14 abutting one another or abutting either side of a filler panel 16 disposed between two modules 14, so that the perimeter 12 is formed. Perimeter 12 is adaptable to a variety of sizes and configurations such as a continuous perimeter design as illustrated in FIGS. 1, 2, 5 and 6. As shown in FIG. 5, the continuous perimeter design can incorporate a plurality of display modules 14 arranged in a rectangular configuration with the modules 14 located at the corners of the structure 10 forming exterior mitered corners 26. As shown in FIGS. 6 and 7, configurations incorporating interior mitered corners 28 as well as exterior mitered corners 26 can also be formed while maintaining the continuity of the perimeter 12. The perimeter 12 formed by the display modules 14 defines a refrigerated space 30. The perimeter 12 also forms at least one personnel access opening 32 (FIG. 1) along the perimeter 12 which accommodates ingress and egress of employees and the delivery of refrigerated products to the space 30, or in other embodiments can allow customers to enter the space 30 in order to gain access to refrigerated products from within the space 30. The structure 10 can incorporate display doors 34 which mount to the exterior display frame 22 within perimeter 12 in order to close the display openings 24. Additionally, the structure 10 can incorporate at least one personnel access door 36 or curtain or other closure means which mounts to the perimeter 12 in order to provide a barrier to the personnel access opening 32.

As shown in FIGS. 3 and 5, the refrigerated space 30 of the preferred embodiment incorporates a storage area 38, as well as shelves 40 which are part of the display module 14 and which are positioned adjacent the display openings 24. The shelves 40 support the products 42 and are positioned between the storage area 38 and the perimeter 12. As shown in FIG. 4, the shelves 40 are incorporated into the individual display modules 14 by fastening prongs of the shelves in a conventional known manner to a series of slots 44 contained within display support uprights 46. Each display support upright 46 is formed of a length of "C" channel beam made of steel or other suitable material which is either fixedly mounted or hingedly mounted to a facia panel of its display module 14 by lower and upper spacer bars 48 and 50 which are also formed of lengths of "C" channel material. Display modules 14 incorporating the hingedly mounted support uprights 46 provide for more efficient shipping of modules 14 because the support uprights 46 can be folded toward the interior of the module 14 thereby reducing the depth of the module 14 for transportation to the installation site. A lower spacer bar 48 mounts to the lower end portion of each upright 46 and attaches to the interior of the display module lower facia panel 20 while an upper spacer bar 50 mounts to the upper end portion of upright 46 and attaches to the interior of display module upper facia panel 18. The spacer bars 48 and 50 thereby establish a fixed distance between the uprights 46 and the display openings 24 within the space 30. Lower and upper support beams, 52 and 54 respectively, are connected at the ends of the uprights 46 and maintain the alignment and spacing of the uprights 46. Lower support beams 52 attach to uprights 46 in the vicinity of the joints formed between the lower spacer bars 48 and uprights 46 while upper support beams 54 attach to uprights 46 in the vicinity of the joints formed between upper spacer bars 50 and the uprights 46. Upper support beams 54 also serve as a mounting surface for air handling roof modules 56 which form the ceiling of the space 30.

The storage area 38 provides an area for storing products which can be in boxes 58 within the structure 10 so that when the shelves 40 require restocking with products 42, an employee enters the storage area 38 by means of the personnel access opening 32, locates a quantity of previously stored products 42 in the boxes 58 and restocks the shelves 40 with products 42. In this manner, the consumer shopping aisles adjacent the outside of the structure 10 remain free of refrigerated products and employees during restocking, thereby relieving potential consumer traffic flow congestion in the consumer shopping aisles.

Figure 8:
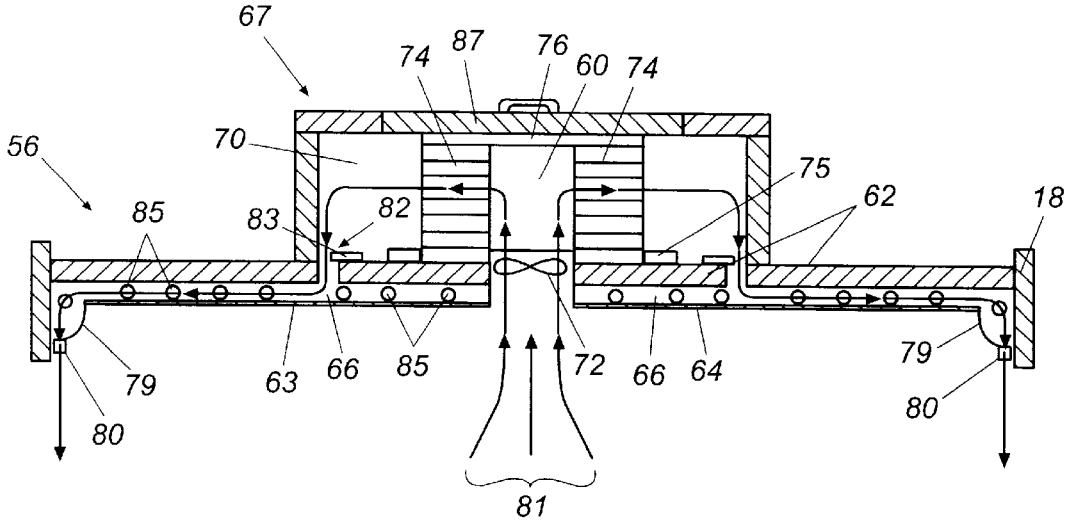
FIG. 8 illustrates a cross-sectional end view of the present invention showing detail of the air handling roof module.

The structure 10 of the embodiment of the invention shown in FIGS. 1, 2 and 3, also incorporates a plurality of air handling roof modules 56 serving as structural roof panels supported by the support uprights 46 of the display modules 14. As shown in FIG. 3 and detailed in FIG. 8, the roof modules 56 are placed side-by-side with one another and each includes an air passage 60 which can be adapted to draw an inlet flow of air from various heights within space 30 by extending the passage 60 downwardly into space 30, an external insulated roof panel 62, and a ceiling panel 64. Panels 62 and 64 are spaced from each other by joists 66 which are formed from lengths of steel "C" channel beams and which support the roof modules 56 on the display modules 14. Spaces between the joists 66 function as part of an air distribution plenum 68 which will be described in more detail hereinafter. Perimeter 12 formed by the display modules 14 engages the sides of the roof modules 56 in order to maintain alignment of the roof modules 56 above the refrigerated space 30.

Figure 9:
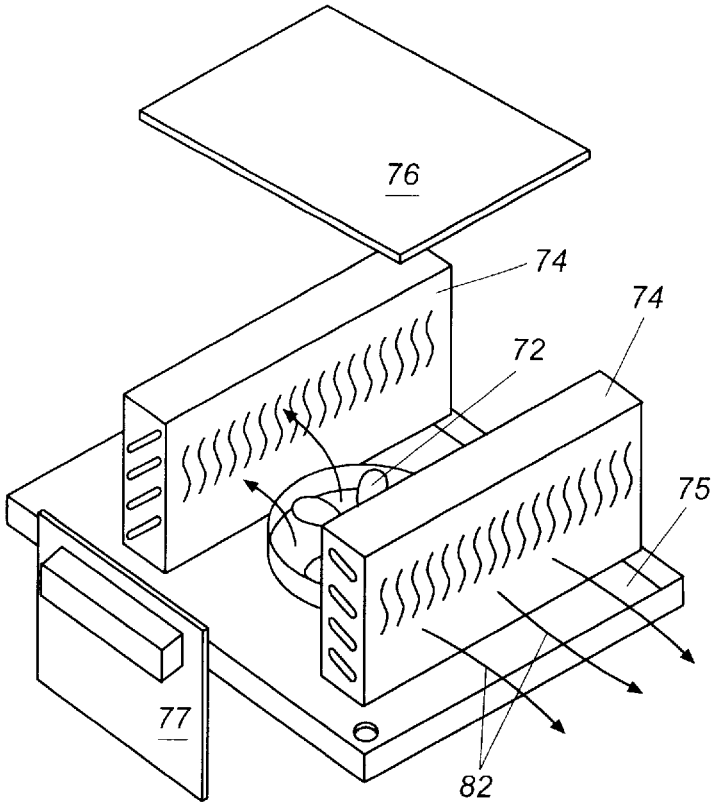
FIG. 9 illustrates a partially exploded perspective view of a modular refrigeration unit.

Roof panel 62, ceiling 64 and joists 66 provide support to a refrigeration module 67 as well as define the air distribution plenum 68. The refrigeration module 67 communicates with air passage 60 and incorporates a refrigeration plenum 70, a fan 72 and a pair of refrigeration coils 74 mounted in a drip pan 75 with each refrigeration 74 positioned between the fan 72 and air distribution plenum 68. Alternative embodiments of the refrigerated structure can incorporate various fan and refrigeration element combinations which include multiple fans per refrigeration coil as well as multiple refrigeration coils per fan. In the preferred embodiment as shown in FIG. 9, a stabilizer plate 76 is mounted to the upper surfaces of the refrigeration coils 74 to integrate the fan 72, the refrigeration coils 74, the drip pan 75, and a refrigeration unit control panel 77 as a refrigeration unit 78.

Figure 10:
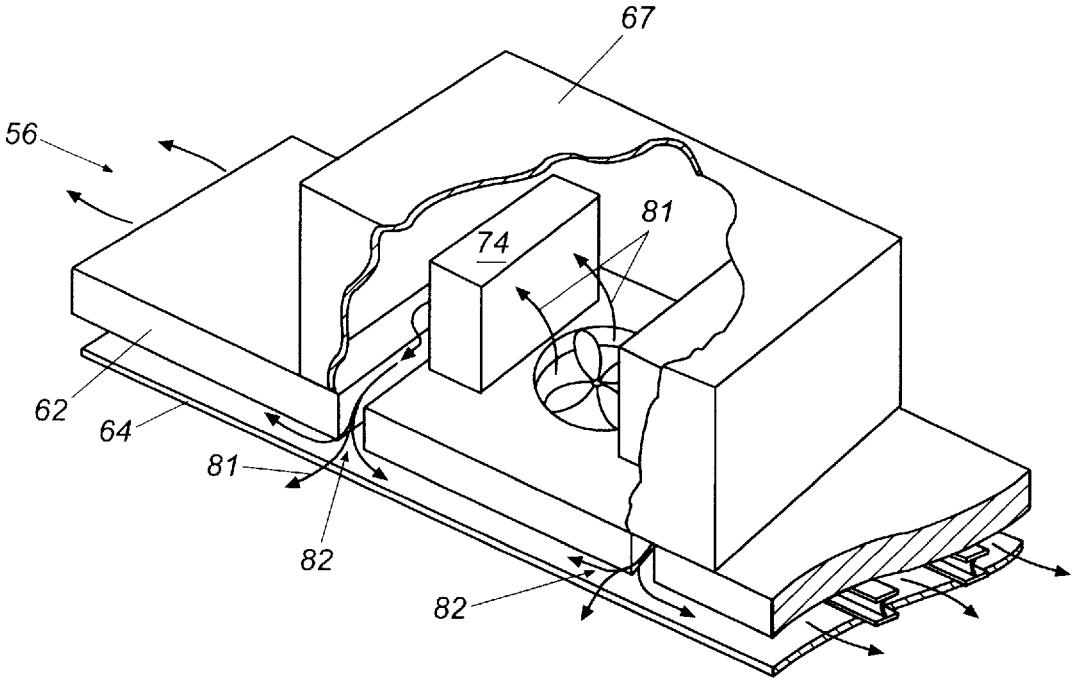
FIG. 10 illustrates a cut-away perspective view showing detail of the air distribution openings.

The air distribution plenum 68 incorporates a perimeter plenum 79 adjacent the perimeter 12 above the display openings 24 communicating with a plurality of air outlets 80 which function as air flow directors for directing refrigerated air toward the products, and which can incorporate an airflow diffuser of a honeycomb design. The fan 72 operates in fluid communication with the refrigeration coils 74 such that the fan 72 draws air 81 upwardly from the storage area 38, through the air passage 60 and into the refrigeration module 67, where the fan 72 and the shape of the module 67 force the air 81 laterally outwardly through each of the refrigeration coils 74 into the refrigeration plenum 70, and then through air distribution openings 82 into the air distribution plenum 68, then outwardly into the plenum 79 at the perimeter 12 of the structure 10. The air 81 then flows downwardly through the outlets 80 between the display openings 24 and the shelves 40 so that the products 42 displayed on the shelves 40 are cooled by a flow of cold refrigerated air 81. Auxiliary fans 84 can be mounted below the display openings 24 to urge the flow of refrigerated air 81 downwardly past the display openings 24 and about the displayed products 42, and thereafter direct the air 81 toward the storage area 38. In this configuration, personnel in the storage area 38 are not directly exposed to the cold refrigerated flow of air 81 directed at the displayed products 42, thus providing a more comfortable environment for personnel and an efficient means for refrigerating the displayed products. The air distribution openings 82, as shown in FIG. 10 as slots in the roof panel 62, traverse each joist 66 thereby allowing refrigerated air 81 departing the refrigeration plenum 70 to laterally cross each joist 66 so that refrigerated air 81 can flow through the entire air distribution plenum 68 formed within an air handling roof module 56. Each air distribution opening 82 can also incorporate baffles 83 which can be adjusted to regulate the flow of air 81 from the refrigeration plenum 70 into the air distribution plenum 68.

Figure 11:
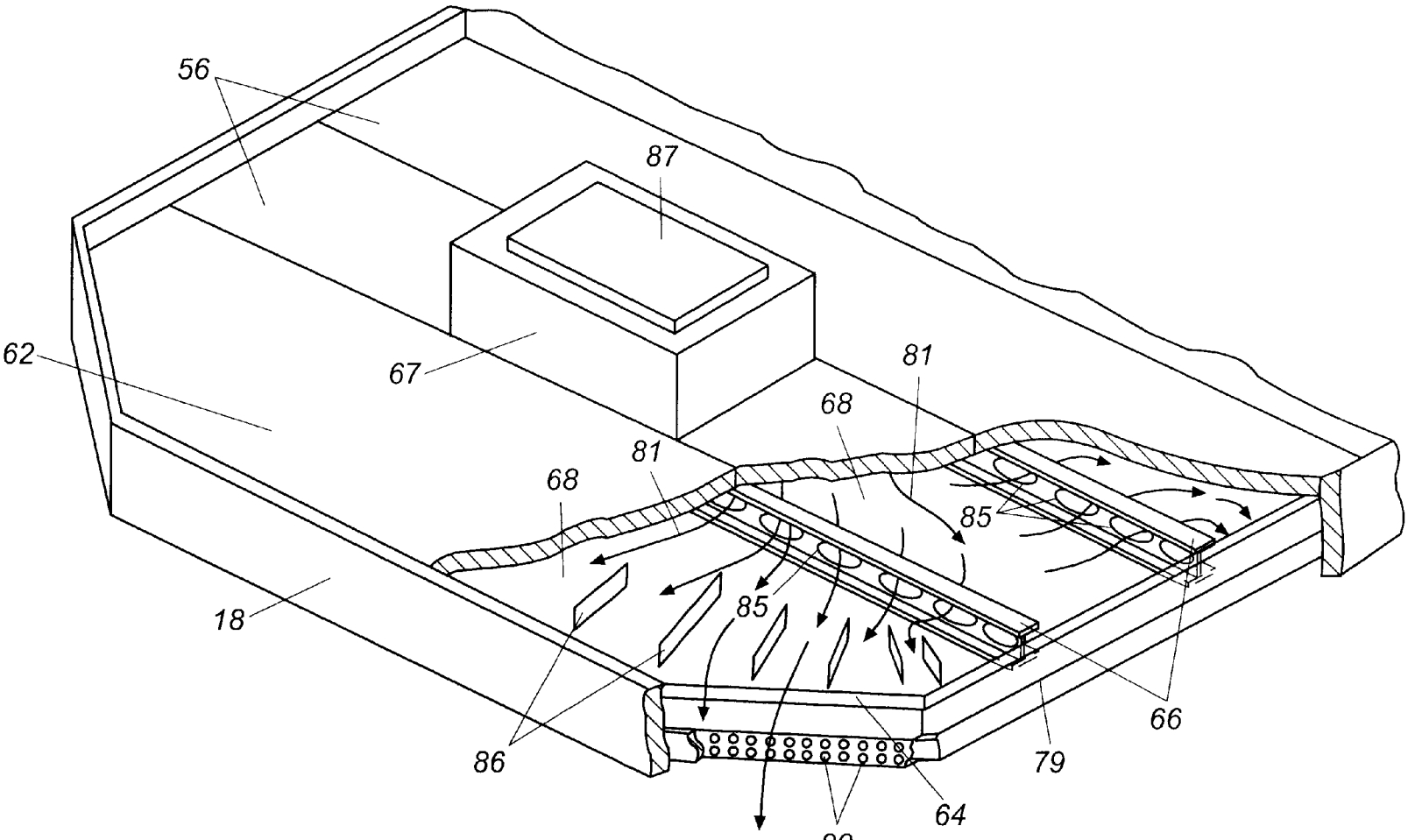
FIG. 11 illustrates a cut-away perspective view showing detail of the roof module structure and air distribution plenum.

As illustrated in FIGS. 1 and 2, each air handling roof module 56 is adapted to operatively engage other air handling roof modules 56 such that several roof modules 56 may be arranged and connected in side-by-side alignment with each other to form the roof of structure 10. In an alternative embodiment, the respective air distribution plenum 68 of each air handling roof module 56 engages in fluid communication with other air distribution plenums 68 attached thereto through a series of flow holes 85 arranged within joists 66 as well as by the communicating air flows provided through the air distribution openings 82. In this manner, cold air 81 produced from one refrigeration coil 74 can provide an improved flow of refrigerated air 81 through flow holes 85 to any part of the perimeter 12 of the structure 10 (FIG. 11) through the interlocking air distribution plenums 68. Because of this refrigerated flow redundancy, a set of refrigeration coils 74 within a module 67 may be taken out of service for maintenance or defrosting without significantly degrading the flow of cooling air 81 to the products 42 contained within the structure 10. This represents an improvement over the prior art, where taking a refrigeration unit out of service typically requires taking the entire refrigerated cabinet out of service, thus potentially requiring increased labor to move the displayed products 42 to a different refrigerated location. Additionally, in order to direct a sufficient flow of air to the end of the structure 10, a series of turning vanes 86 (FIG. 11) can be arranged in the air distribution plenum 68 to direct the air 81 provided through holes 85 to the outlets 80 positioned along the perimeter 12 at the end of the structure 10.

Refrigeration modules 67, mounted atop the roof modules 56, can each incorporate a maintenance access door 87 which provides a convenient means for mechanics to obtain access to the interior of the refrigeration module 67 including the refrigeration coils 74 and most of the components contained within the module 67. With access to the air handling roof module 56 and the refrigeration components on top of the structure 10 and away from the refrigerated space 30, a mechanic can be positioned on the top of the structure 10 during maintenance, and therefore, out of the refrigerated space 30 and the consumer shopping aisles.

Additionally, as shown in FIG. 7, insulated filler panels 16 can incorporate segments of utility conduit 88 for ease of installation and maintenance of structure 10 by providing a prefabricated single point utility hook-up for the entire structure 10. Conduit segments 88 are created by embedding lengths of PVC tubing in the panel mold prior to forming the insulated panel 16.

Figure 12:
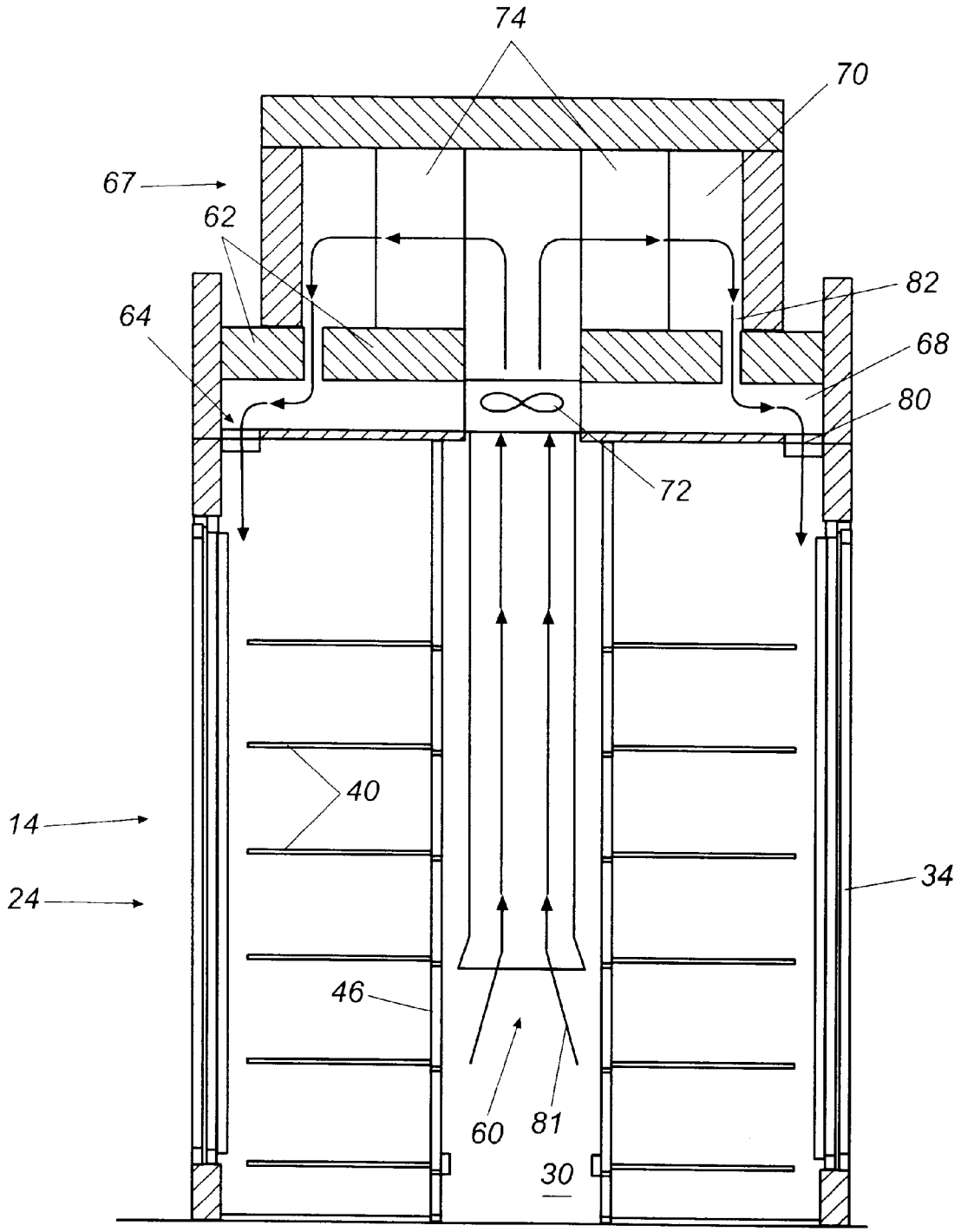
FIG. 12 illustrates a cross-sectional end view of an alternative embodiment of the invention configured without an internal storage area.

As shown in FIG. 12, an alternative embodiment of the present invention is arranged with display modules 14 arranged in a close back-to-back orientation thereby displacing the storage area 30 and the associated personnel access opening 32. This configuration is well suited for use in stores lacking the required space for larger refrigerated structures or for beverage coolers and other typically smaller refrigerated structures which do not require access to the display shelves 40 from within the refrigerated space 30. Display doors 34 to normally close the display openings 24 can also be incorporated. Additionally, since the air outlets 81 of the display modules 14 are in close proximity to the air passage 60, the air passage 60 can incorporate a configuration which extends downwardly into the refrigerated space 30 in order to promote the continued downward flow of air 81 exiting the outlets 80 and past the shelves 40 prior to being drawn into the air passage 60 by the return flow of air 81.

Figure 13:
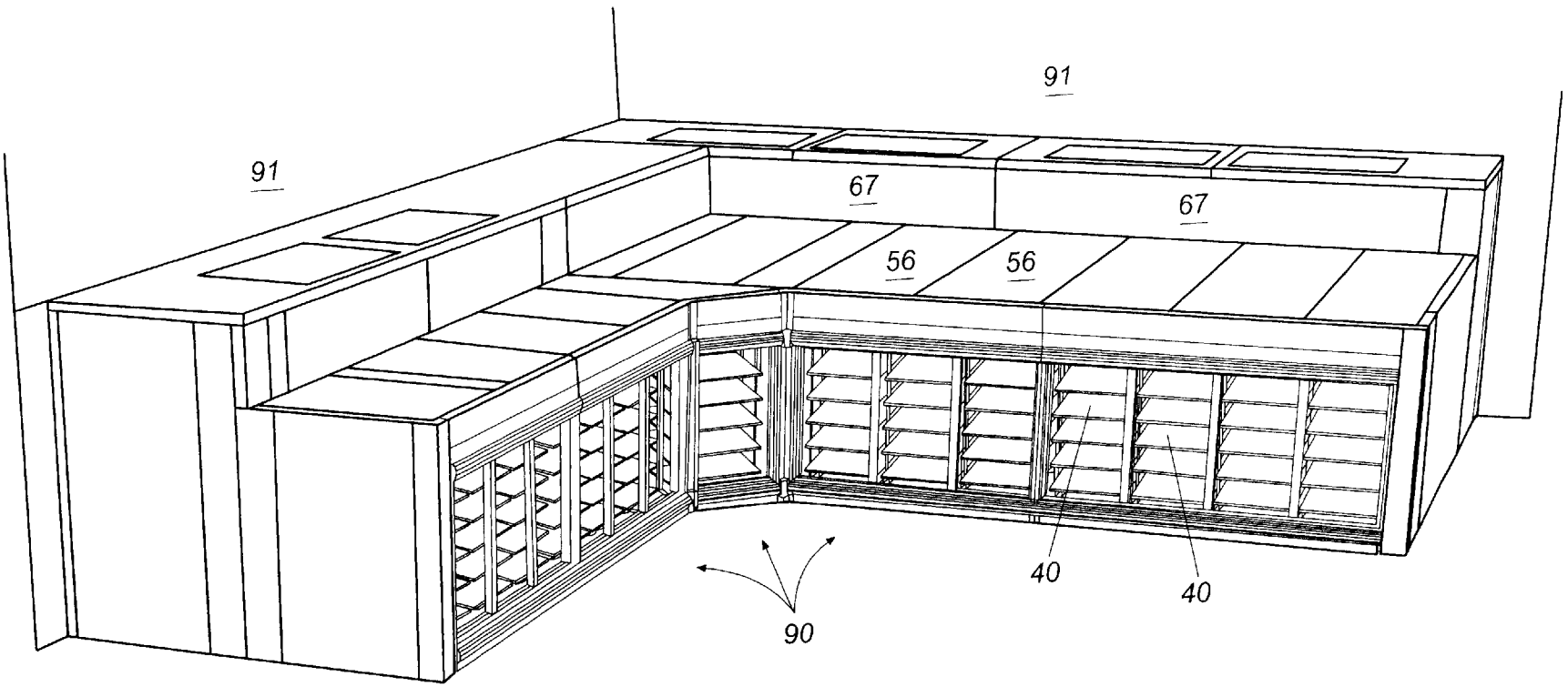
FIG. 13 illustrates a perspective view of an alternative embodiment of the invention configured as a perimeter-conforming rear load display and storage structure.
Figure 14:
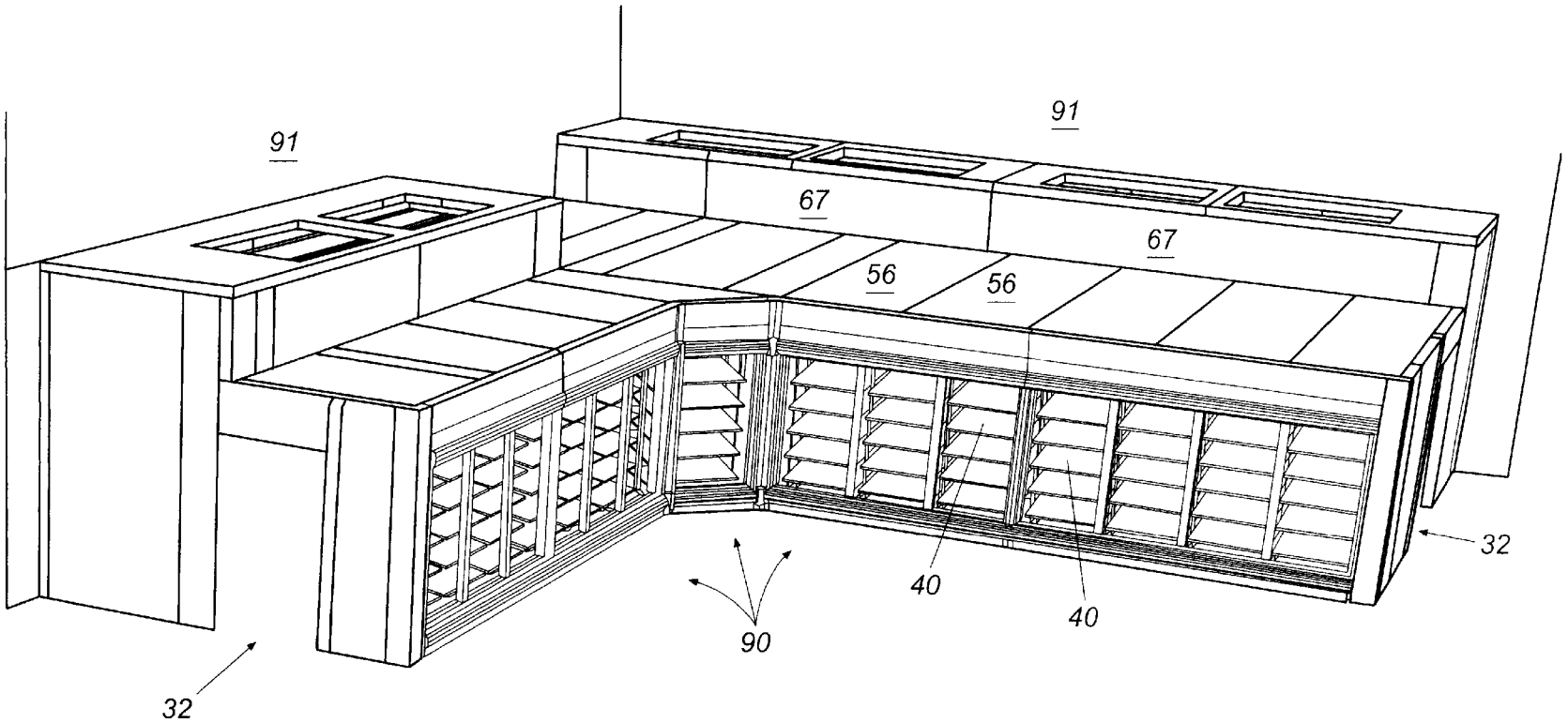
FIG. 14 illustrates a perspective view of an alternative embodiment of the invention configured as a perimeter-conforming side access display and storage structure.
Figure 15:
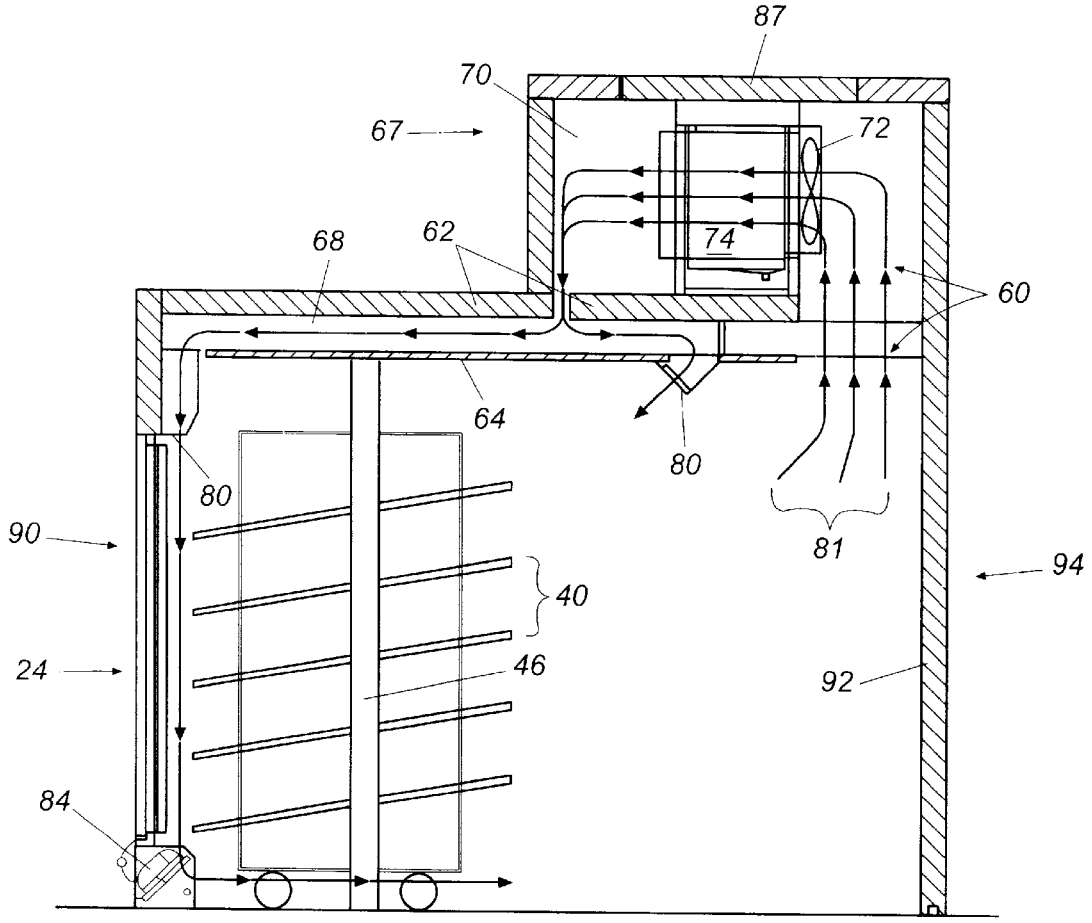
FIG. 15 illustrates a cross-sectional end view of a perimeter-conforming display and storage structure.

Perimeter-conforming embodiments such as rear load (FIG. 13) and side load (FIG. 14) refrigerated structures are formed by linking display modules 14 to form a front display wall 90. These configurations are well suited for replacing traditional grocery dairy cases and similar product arrangements by providing access to the display shelves 40 for loading replacement products from either the back of the structure 10 which can be adapted to be readily accessible from the back storage or warehouse section of a typical retail grocery store or a side of the structure through a personnel access opening 32. As shown in FIG. 15, air handling roof modules 56 mounted on top of the display modules 14 are supported by the modules 14 and can also be supported by support uprights 46, the wall 91 of the building next to which the display modules 14 are placed or by support modules 92 which can form the back loading wall 94 of the rear load embodiment. Since the perimeter-conforming embodiments need only have display means such as shelves 40 positioned adjacent the display openings 24 along the front display walls 90, both air outlets 80 of the air handling roof modules 56 can be directed toward the shelves 40.

The foregoing description has been presented for purposes of illustration and description. It is not intended to be exhaustive or to limit the invention to the precise forms disclosed. Obvious modifications or variations are possible in light of the above teachings. The embodiment or embodiments discussed were chosen and described to provide the best illustration of the principles of the invention and its practical application to thereby enable one of ordinary skill in the art to utilize the invention in various embodiments and with various modifications as are suited to the particular use contemplated. Specifically, the invention has been generally presented in a form suited for the storing and displaying of food items, however, the present invention is equally well suited to a variety of alternative uses such as storing and displaying of flowers and other refrigerated items and for providing non-display refrigerated storage and workspace structures including environmental chambers. Additionally, while shelves have typically been disclosed for displaying products adjacent the display openings, a variety of display devices are equally well suited for use in the invention including, among others, wire racks, baskets, hooks and portable display devices such as rolling display carts and racks. Furthermore, support structures for the air handling roof modules have been disclosed as bottom supporting structures such as display modules and support modules which can be linked together in various combinations, however, the present invention is equally well suited to support structures which are positioned above the roof modules such as support cables or beams suspended downwardly from the interior ceiling structure of a building and attaching to the roof module joists, as well as support structures which are positioned beside the roof modules such as cantilevered support beams extending laterally from an adjacent wall structure. All such modifications and variations, among others, are within the scope of the invention as determined by the appended claims when interpreted in accordance with the breadth to which they are fairly and legally entitled.

What is claimed is:

1. A modular refrigerated structure for containing refrigerated products, comprising:

a support structure;

a refrigerated display area formed by said support structure;

a roof structure supported by said support structure, said roof structure formed by a plurality of adjacent roof modules, each of said roof modules having an air distribution plenum with at least some of said air plenums of adjacent roof modules in fluid communication with each other;

a refrigerated storage space disposed below said roof structure and adjacent said display area, said refrigerated storage space engaging in fluid communication with said refrigerated display area and said air distribution plenums of said roof modules; and at least one of said roof modules supporting a refrigeration module, said refrigeration module having an air inlet in fluid communication with said refrigerated storage space and an air outlet in fluid communication with said air plenums, said refrigeration module having a refrigeration unit for cooling air moved therethrough, and maintenance access means for accessing said refrigeration unit from outside refrigerated space, said refrigeration unit having at least one refrigeration coil and fan means;

said fan means, refrigeration coil and distribution plenums arranged to move air from said refrigerated space, through said refrigeration coils, through said air distribution plenums of adjacent ones of the roof modules and then from the plenums of the roof modules into said refrigerated display area and back into said refrigerated space for cooling the products in said refrigerated display area and in said refrigerated space.

2. The refrigerated structure of claim 1, wherein:

said support structure is further defined as having at least one display opening such that products contained within said refrigerated space can be accessed through said display opening.

3. The refrigerated structure of claim 1, wherein:

said support structure comprises a plurality of display modules, said display modules being adapted to attach to others of said display modules such that a variety of support structure configurations can be achieved by assembling said display modules in side-by-side configuration.

4. The refrigerated structure of claim 3, wherein:

each of said display modules has at least one support upright for supporting said roof modules.

5. The refrigerated structure of claim 6, wherein:

said support structure comprises a plurality of self supporting display modules each having an exterior display frame and an upright support mounted to and displaced from said exterior display frame;

said roof modules each resting on said display modules; and, said refrigeration modules each being mounted on one of said roof modules.

6. The refrigerated structure of claim 1, wherein:

said support structure comprises a plurality of self supported display modules arranged in side-by-side relationship and form an exterior perimeter of said refrigerated structure.

7. The refrigerated structure of claim 6, wherein:

said display modules are further defined as each having at least one display opening.

8. The refrigerated structure of claim 7, wherein:

said display openings are further defined as having transparent door means for normally closing said display openings.

9. The refrigerated structure of claim 8, further comprising:

a storage area within said refrigerated space and adjacent said display means such that products can be stored within said storage area; and, a personnel access opening arranged in said exterior perimeter for accessing said storage area.

10. The refrigerated structure of claim 9, further comprising:

door means for normally closing said personnel access opening.

11. A modular refrigerated structure for containing refrigerated products, comprising:

a plurality of self-supporting display modules each including an exterior display frame defining at least one display opening, support uprights spaced from said exterior display frame, and display means mounted to said support uprights and positioned between said support uprights and said exterior display frame and adjacent the display opening of its display module for displaying refrigerated products;

said display modules positioned with their exterior display frames in side-by-side relationship with respect to one another and forming an exterior of said structure and defining a refrigerated space inside said structure with the display openings of said display modules forming an array of display openings about said structure such that products contained within said refrigerated space can be accessed through said display openings;

said refrigerated space having a storage area positioned interiorly of said display means;

at least one personnel access opening formed in said exterior for personnel ingress and egress into and out of said refrigerated space;

a roof structure mounted on said support uprights and formed by a plurality of air handling roof modules positioned side-by-side, each of said air handling roof modules having a roof panel, a ceiling panel and spacers joined to and supporting said roof panel and said ceiling panel in a spaced relationship such that said roof panel and said ceiling panel define said air distribution plenum said ceiling panel being arranged adjacent said storage area;

at least one refrigeration module, each refrigeration module supported by at least one of said air handling roof modules such that said refrigeration module is arranged above said roof panel of said at least one of said air handling roof modules and outside said storage area;

an air passage in fluid communication with said storage area and each of said refrigeration modules;

a refrigeration unit in each of said refrigeration modules for moving air upwardly from said storage area and into said refrigeration module such that air is moved upwardly from said storage area, through said air passage and above said ceiling panels and said roof panels, through said refrigeration unit, and then downwardly below said ceiling panels and said roof panels and between said display openings and said display means for cooling refrigerated products on said display means.

12. The refrigerated structure of claim 11, wherein:

each refrigeration module further includes maintenance access means adjacent its refrigeration unit so that personnel can access the refrigeration unit from atop said roof structure and outside said refrigerated space.

13. The refrigerated structure of claim 12, further comprising:

auxiliary fan means positioned at the lower portion of at least one of said display openings for drawing air downwardly between said display opening and said display means.

14. The refrigerated structure of claim 13, further comprising:

door means mounted to at least one of said exterior display frames for closing said display openings.

15. The refrigerated structure of claim 12, wherein:

said external display frames are positioned in a closed continuous array and said array is in the form of a rectangle having exterior mitered corners.

16. A modular refrigerated structure for containing refrigerated products, comprising:

a plurality of display modules positioned side-by-side and forming an exterior wall structure and defining a refrigerated space inside said exterior wall structure;

said display modules each defining at least one display opening;

at least one personnel access opening formed in said exterior wall structure for personnel ingress and egress in and out of said refrigerated space;

display means positioned in said refrigerated space adjacent said display openings for supporting refrigerated products;

a storage area positioned interiorly of said display means;

a roof structure mounted to said perimeter, said roof structure including a plurality of air handling roof modules mounted side-by-side, each air handling roof module including an air distribution plenum in fluid communication with the air distribution plenums of other ones of said roof modules and air outlets directed toward said perimeter of said refrigerated structure above said display openings, each of said air handling roof modules having a roof panel and a ceiling, panel in a spaced relationship such that said roof panel and said ceiling panel define said air distribution plenum;

at least one of said roof modules including an air inlet passage positioned above and in fluid communication with said storage area, and a refrigeration module positioned above said plenums and in communication with said air passage and the air distribution plenums of said roof modules, each said refrigeration module including maintenance access means for providing access to the interior of the refrigeration module from outside said roof structure, at least one refrigeration coil, a refrigeration plenum and fan means arranged to move air upwardly from said storage area into its refrigeration module;

such that air moves upwardly from said storage area, into said air inlet passage, into said refrigeration module, through said refrigeration coil, through said refrigeration plenum, outwardly through said air distribution plenum, through said air outlets and downwardly between said display openings and said display means for cooling products positioned on said display means.

17. The refrigerated structure of claim 16, further comprising:

door means mounted to said perimeter for normally closing said display openings.

18. The refrigerated structure of claim 16, further comprising:

door means for normally closing said employee access opening.

19. The refrigerated structure of claim 16, wherein:

said roof structure is supported on said display means.

20. The refrigerated structure of claim 16, further comprising:

auxiliary fan means positioned at the lower portion of at least one display opening for drawing air downwardly between said display openings and display means.

21. The refrigerated structure of claim 16 wherein:

said air distribution opening is further defined as having an adjustable baffle for regulating the flow of air into said air distribution plenum.

22. The refrigerated structure of claim 16, wherein:

each of said air outlets is further defined as incorporating a honeycomb air flow directing structure.

23. The refrigerated structure of claim 16, wherein:

said fan means and said auxiliary fan means are further defined as having variable speed settings.

24. A modular refrigerated structure for containing refrigerated products comprising:

a plurality of display modules having display openings arranged in side-by-side relationship forming a modular front display wall;

a rear wall displaced from said front display wall, said modular front display wall and said rear wall defining a refrigerated space;

a roof structure including a plurality of side-by-side roof modules, each of said roof modules having a roof panel, a ceiling panel and spacers joined to and supporting said roof panel and said ceiling panel in a spaced relationship, and forming therebetween an air distribution plenum in each roof module and air outlets in communication between said air distribution plenum, and said refrigerated space;

a refrigeration module mounted on at least one of said roof modules, each of said refrigeration modules having a refrigeration coil;

said roof modules having a refrigeration module mounted thereon also including an air passage positioned over said refrigerated space;

display means positioned adjacent said display openings for displaying products adjacent said display openings; and fan means positioned at said air passage of said roof modules that have a refrigeration module and arranged to move air upwardly from said refrigerated space into said refrigeration module, laterally outwardly through said refrigeration module and through said air distribution plenum toward said air outlets, and then downwardly through said outlets adjacent said display openings for cooling products displayed on said display means.

25. The refrigerated structure of claim 24, wherein:

each of said display modules include support uprights for supporting said roof modules.

26. The refrigerated structure of claim 25, wherein:

said refrigerated space is further defined as including a storage area for storing replacement products.

27. The refrigerated structure of claim 26, wherein:

some of said air outlets are further defined as being arranged to direct cooling air toward said storage area.

28. The refrigerated structure of claim 27, further comprising:

at least one personnel access opening for personnel ingress and egress in and out of said storage area.

29. A method of refrigerating products within a refrigerated structure, comprising the steps of:

arranging a plurality of display modules side-by-side to form a front display wall;

placing a rear wall in displaced arrangement with respect to the front display wall and defining between the rear wall and the front display wall a refrigerated space;

supporting air handling roof modules on the display modules, each of said air handling roof modules having a roof panel and a ceiling panel in a spaced relationship such that said roof panel and said ceiling panel define an air distribution plenum, said ceiling panel being arranged adjacent said refrigerated space;

arranging refrigerant-cooled refrigeration coils above said roof panels;

arranging display means in the refrigerated space adjacent the front display wall;

placing products on the display means;

drawing air upwardly from the refrigerated space into the air handling roof modules and above said ceiling panels and said roof panels;

directing the drawn air through the refrigerant-cooled refrigeration coils for cooling the air; and, directing the cooled air from the refrigeration coils through the air distribution plenum and then downwardly toward the display means for cooling the products on the display means.

30. The method as in claim 29, wherein the step of drawing air upwardly from the refrigerated space comprises drawing the air upwardly with fan means positioned above the refrigerated space into a refrigeration plenum.

31. The method as in claim 30, in which the step of directing air downwardly toward the display means comprises moving air from the refrigeration coils, through an air distribution plenum common to all the air handling roof modules, and then through air outlets mounted adjacent the display means.

32. The method as in claim 29, wherein the refrigerated space includes a storage area for storing replacement products, and further comprising the steps of:

storing products in the storage area;

when space is available for displaying products on the display means, retrieving replacement products from the storage area and placing the products on the display means; and, drawing air upwardly from the storage area.

33. The method as in claim 32, further comprising the step of:

directing the air from about the display means into the storage area.

34. A modular refrigerated structure for containing refrigerated products, comprising:

a wall structure forming a perimeter, a refrigerated space inside said perimeter, a plurality of display openings formed by said wall structure, and at least one personnel access opening formed by said wall structure for personnel ingress and egress in and out of said wall structure;

display means positioned in said refrigerated space at said display openings;

a storage area positioned interiorly of said display means;

a roof structure mounted on said wall structure, said roof structure including a plurality of side-by-side air handling roof modules, each of said air handling roof modules having a roof panel a ceiling panel and spacers joined supporting said roof panel and said ceiling panel in a spaced relationship such that said roof panel and said ceiling panel define an air distribution plenum;

at least some of said air handling roof modules including a refrigeration module mounted above said ceiling panel and said roof panel, air outlets facing in opposite directions, and an air passage extending from said storage area in communication with said refrigeration module;

each of said refrigeration modules including a pair of refrigeration coils, each of said refrigeration coils in fluid communication with said air passage, one refrigeration coil positioned between said air passage and one of said air outlets and the other refrigeration coil positioned between said air passage and said other of said air outlets for cooling air moved through said air handling roof module to opposite sides of said structure;

fan means arranged to move air upwardly from said storage area into said refrigeration module of its air handling roof module, laterally in opposite directions through said refrigeration coils, through said refrigeration plenums, through said air distribution plenum and out of the air outlets of its air handling module and directed downwardly between said display openings and said display means;

such that air is moved by said fan means of each air handling roof module from said storage area upwardly past said ceiling panel and said roof panel and into said refrigeration module of its air handling roof module, laterally in opposite directions through said refrigeration coils, through said refrigeration plenums, through said air distribution plenum and out of said air outlets of its air handling module and directed downwardly between said display openings and said display means.

35. The refrigerated structure of claim 34, wherein:

said display means include support uprights and said roof structure is supported on said support uprights.

36. The refrigerated structure of claim 35, further comprising:

auxiliary fan means positioned at the lower portion of each display opening for drawing air downwardly between said display openings and said display means.

37. A method for refrigerating a space, comprising the steps of:

arranging a roof structure above a refrigerated space;

said roof structure including a roof with the perimeter of the roof extending about the refrigerated space;

supporting a plurality of refrigeration coils with the roof outside the refrigerated space;

forming an air distribution plenum with the roof and a ceiling, said air distribution plenum being arranged between the roof and the refrigerated space and communicating with all of the refrigeration coils and with the refrigerated space about substantially the entire roof;

drawing air upwardly from the refrigerated space, through the roof, and into the refrigeration coils;

cooling the air in the refrigeration coils;

directing the cooled air from the refrigeration coils into the air distribution plenum;

directing the cooled air through the air distribution plenum to substantially the entire perimeter of the roof; and, directing the cooled air downwardly from said air distribution plenum into the refrigerated space about substantially the entire perimeter of the roof and into the refrigerated space.

38. A method for refrigerating a space, comprising the steps of:

arranging a plurality of display modules side-by-side to form a perimeter wall about a space to be refrigerated;

supporting a roof structure on the display modules, said roof structure including a roof with the perimeter of the roof extending about the refrigerated space;

supporting a plurality of refrigeration coils with the roof, outside the refrigerated space;

forming an air distribution plenum with the roof and a ceiling, said air distribution plenum being arranged between the roof and the refrigerated space and communicating with all of the refrigeration coils and with the refrigerated space about substantially the entire roof;

drawing air upwardly from the refrigerated space, through the roof, and into the refrigeration coils;

cooling the air in the refrigeration coils;

directing the cooled air from the refrigeration coils into the air distribution plenum;

directing the cooled air through the air distribution plenum to substantially the entire perimeter of the roof; and directing the cooled air downwardly from said air distribution plenum into the refrigerated space about substantially the entire perimeter of the roof and into the refrigerated space.

39. The method for refrigerating a space according to claim 38, further comprising the step of:

defrosting one of the refrigeration coils; and, continuing to direct cooled air through the air distribution plenum to substantially the entire perimeter of the roof.

* * * * *